US005490388A

United States Patent [19]

Althaus et al.

[11] Patent Number: 5,490,388

[45] Date of Patent: Feb. 13, 1996

[54] GAS TURBINE COMBUSTION CHAMBER HAVING A DIFFUSER

[75] Inventors: Rolf Althaus, Kobe, Japan; Burkhard Schulte-Werning, Basel, Switzerland

[73] Assignee: Asea Brown Boveri Ltd., Baden, Switzerland

[21] Appl. No.: 310,393

[22] Filed: Sep. 22, 1994

Related U.S. Application Data

[63] Continuation-in-part of Ser. No. 124,006, Sep. 21, 1993, abandoned.

[30] Foreign Application Priority Data

Sep. 28, 1992 [DE] Germany ..... 42 32 442.4

[51] Int. Cl.[6] ..... F02C 3/14

[52] U.S. Cl. ..... 60/737; 60/751

[58] Field of Search ..... 60/737, 738, 748, 60/751, 39.36, 752, 760

[56] References Cited

U.S. PATENT DOCUMENTS

| | | | |
|---|---|---|---|
| 3,631,675 | 1/1972 | Keiter | 60/737 |
| 3,899,884 | 8/1975 | Ekstedt | 60/751 |
| 4,112,676 | 9/1978 | Decorso | 60/737 |
| 5,094,069 | 3/1992 | Boffo | 60/751 |
| 5,193,995 | 3/1993 | Keller et al. . | |

*Primary Examiner*—Louis J. Casaregola
*Attorney, Agent, or Firm*—Oblon, Spivak, McClelland, Maier, & Neustadt

[57] ABSTRACT

In a gas turbine combustion chamber in which for cooling purposes use is made of combinations of convective heat transfer mechanisms whose basic principle is the elimination of heat by flow, the transition from the convective cooling channel (4) to the plenum upstream of the burners (5) is in the form of a small diffuser (6). The total pressure loss in the entire system is thereby reduced, thus leading to improved efficiency with minimum emissions.

3 Claims, 1 Drawing Sheet

GAS TURBINE COMBUSTION CHAMBER HAVING A DIFFUSER

This application is a continuation-in-part of application Ser. No. 098/124,006, filed Sep. 21, 1993, and now abandoned.

BACKGROUND OF THE INVENTION

1. Field of the Invention

The invention relates to a gas turbine combustor, i.e., combustion chamber, with a premixing type burner in which for cooling purposes use is made of combinations of convective heat transfer mechanisms whose basic principle is the elimination of heat by flow.

2. Discussion of Background

Gas turbine combustion chambers of this kind, i.e., with premixing type combustion burner, are known from, for example, U.S. Pat. No. 5,193,995 which is herein incorporated by reference. The cooling air speed required for applying the above-mentioned basic principle is produced therein by a pressure drop. Because of the frictional effects in the cooling ducts, a part of the kinetic energy of the cooling medium is in principle irreversibly converted into heat and the total pressure is thereby reduced.

For good heat transfer properties of the cooling air, high speeds and therefore super-proportionally high dynamic pressures are necessary in the flow duct.

The transition from the convective cooling duct to the plenum upstream of the burners was hitherto achieved through discontinuous widening of the flow cross section, thus ejecting the fluid in an uncontrolled manner. The disadvantage of this prior art is that this entails an almost complete loss of dynamic pressure since all of the combustion air flows through the burner itself. That is, since all of the combustion air is used to cool the walls of the combustion chamber, the air flows at high speed through the cooling duct, resulting in friction induced pressure losses. This leads to a corresponding total pressure loss affecting the process. This is reflected in a lowering of the efficiency and power of the gas turbine plant.

SUMMARY OF THE INVENTION

Accordingly, one object of the invention is to provide a novel configuration of the transition from the convective cooling duct in a gas turbine combustion chamber to the plenum of the burner such that the total pressure loss in the entire system is reduced. In addition, a further object is to provide greater scope in configuration for convective cooling measures for the combustion chamber walls, so that the efficiency of the gas turbine is improved in relation to the prior art.

According to the invention this is achieved through the fact that the transition from the convective cooling duct to the plenum upstream of the burners is in the form of a small diffuser.

More particularly, according to the invention a gas turbine combustion chamber comprises an outer casing and an inner casing positioned within the outer casing and spaced from the outer casing so as to form a cooling duct therebetween, through which cooling gas may flow. A burner is positioned at one end of the inner casing and a plenum is defined around the burner and connected to the cooling duct so as to receive all of the cooling gas from the cooling duct. A diffuser extends into the plenum from one end of the inner casing and is separate from the burner. The diffuser is so configured as to recover as much as possible, and preferably at least 50%, of the dynamic pressure of the cooling gas flowing from the cooling duct into the plenum.

The inner casing is imperforate and the burner is a premixing low-pollution type burner. That is, all of the cooling gas in the cooling duct between the inner and outer casings is discharged into the plenum before mixing with the fuel in the burner. The premixing of the combustion air with the fuel in the burner enhances complete combustion and reduces pollution to a minimum.

The advantages of the invention include that of reducing the hitherto usual almost complete loss of dynamic pressure in such a premixing type burner. The configuration of the transition from the convective cooling duct to the plenum upstream of the burners in the form of a small diffuser, in accordance with the invention, leads at the same time to greater scope in configuration for convective cooling measures for the combustion chamber walls, and thus to an increase in efficiency of the gas turbine plant.

This technique makes it possible to avoid the need for local film cooling methods while also avoiding a sharp increase in pressure losses. All of the cooling air goes through the burner without an increase in the pressure loss, and so the efficiency of the gas turbine increases with simultaneous optimization of the NOx emissions.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, which illustrates one example of embodiment of the invention and in which the single figure shows a partial longitudinal section through the gas turbine combustion chamber.

Only those elements which are essential for an understanding of the invention are shown. The direction of flow of the working medium is indicated by arrows.

DESCRIPTION OF THE PREFERRED EMBODIMENT

Figure 1:
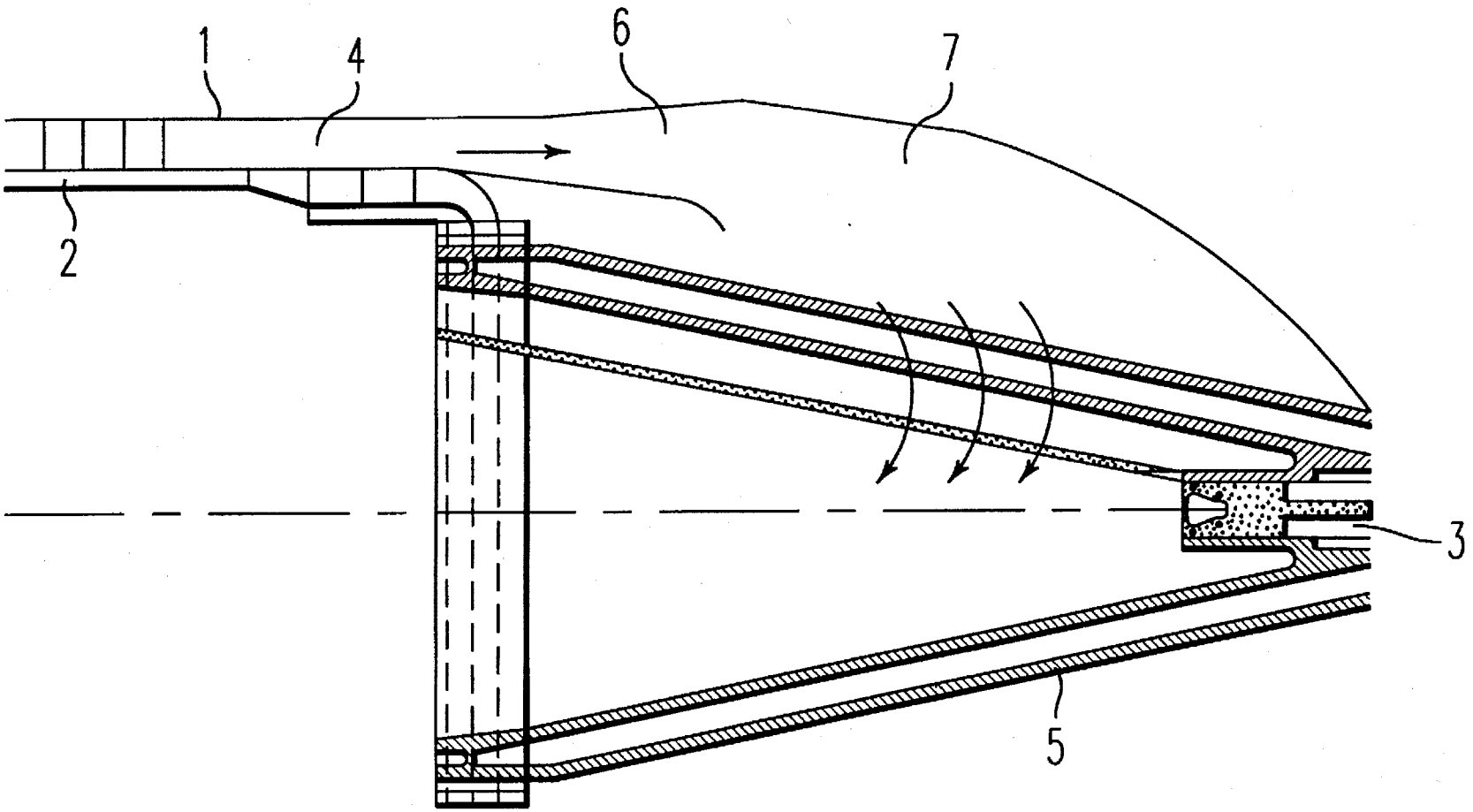

Referring now to the drawings, in FIG. 1 a part of the gas turbine combustion chamber is shown. It consists of the outer casing 1, which has to absorb the compressive forces, and of the inner casing 2, which is directly exposed to the hot combustion gases. The cooling air, which keeps the imperforate inner casing 2 at the temperature required for its strength and cools it, flows between the outer casing 1 and the inner casing 2 to the closed plenum 7 surrounding the burner 5. The burner 5 is a premixing double cone burner such as that shown in U.S. Pat. No. 5,193,995. From there, it flows through air inlet slots (not shown) in the walls of the burner to reach the interior of the burner. Gaseous fuel is also injected through the air inlet slots. The fuel jet 3 atomizes the liquid fuel, which mixes with the combustion air in the burner for subsequent combustion.

The transition from the convective cooling duct 4 to the plenum upstream of the premixing burner 5 is formed according to the invention by the small diffuser 6, which serves to retard the flow of cooling air in a controlled manner and to recover a part of the pressure which would otherwise be lost by the flow of the high speed cooling air from the cooling duct to the plenum. The diffuser projects into the plenum and the inlet of the diffuser is located in the plane of the plenum inlet so that the high flow speed and thus the high cooling effect in the cooling duct 4 is maintained up to plenum inlet.

With the requirement of a minimum recovery of 50% of the dynamic pressure, a simple rough estimate will indicate the geometrical design of the small diffuser 6.

In one example of embodiment the small diffuser 6 has a duct height of 10 mm at the end of the cooling path. With a predetermined widening ratio of 1.7, the usual diffuser design diagrams give, for optimum pressure recovery, a divergence angle of 10° and a diffuser length of 40 mm. These values can be achieved without difficulty in a customary combustion chamber design.

An advantage of the invention consists in that the total pressure loss in the entire system is reduced in comparison with the prior art premixing type combustion chambers in which pressure losses are normally high due to the high speed flow of all of the cooling gas from the cooling duct to the plenum. This allows for using all air for premixing and therefore minimum NOx emissions without efficiency restrictions. In the widened space no cooling measures are required because no heat is supplied by the combustion. Another advantage is that the inner wall 2 is cooled completely by convection. Thus, it does not have ports through which the secondary air flows into the combustion chamber.

Obviously, numerous modifications and variations of the present invention are possible in light of the above teachings. It is therefore to be understood that within the scope of the appended claim, the invention may be practiced otherwise than as specifically described herein.

List of Reference Numerals

1. Outer casing
2. Inner casing
3. Fuel jet
4. Convective cooling duct
5. Burner
6. Small diffuser
7. Plenum

What is claimed as new and desired to be secured by Letters Patent of the United States is:

1. A gas turbine combustion chamber comprising:

an outer casing of the combustion chamber;

an imperforate inner casing of the combustion chamber positioned within said outer casing and spaced from said outer casing so as to form a cooling duct therebetween, through which cooling gas may flow for cooling the combustion chamber;

a premixing burner positioned at a downstream end of said inner casing in a cooling gas flow direction;

a plenum defined around said burner and having an intake connected to said cooling duct so as to receive the cooling gas from said cooling duct; and a diffuser extending into said plenum from said downstream end of said inner casing, said diffuser having an intake located in the same plane as the plenum intake and being configured so as to recover a maximum amount of the dynamic pressure of the cooling gas flowing from said cooling duct into said plenum.

2. The combustion chamber of claim 1 wherein said diffuser has one end mounted to said inner casing and is separate from said burner.

3. The combustion chamber of claim 1 wherein said maximum amount is at least 50%.

* * * * *